US007880605B2

(12) United States Patent
Leyden et al.

(10) Patent No.: US 7,880,605 B2
(45) Date of Patent: Feb. 1, 2011

(54) SECURITY SYSTEM FOR PORTABLE DEVICE WITH ARMING FEATURE

(75) Inventors: Roger Leyden, Inverness, IL (US); Terrance Surma, Carol Stream, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 306 days.

(21) Appl. No.: 12/217,853

(22) Filed: Jul. 8, 2008

(65) Prior Publication Data

US 2010/0007482 A1 Jan. 14, 2010

(51) Int. Cl.
*G08B 29/00* (2006.01)

(52) U.S. Cl. ..... 340/506; 340/571; 340/568.1; 340/531

(58) Field of Classification Search ..... 340/506, 340/571, 531, 568.1, 540, 541, 546, 545.2
See application file for complete search history.

(56) References Cited

U.S. PATENT DOCUMENTS

2006/0181408 A1* 8/2006 Martin ..... 340/528
2007/0146134 A1* 6/2007 Belden et al. ..... 340/571

* cited by examiner

*Primary Examiner*—George A Bugg
*Assistant Examiner*—Hongmin Fan
(74) *Attorney, Agent, or Firm*—Wood, Phillips, Katz, Clark & Mortimer

(57) ABSTRACT

A security system and method of monitoring a portable device. The security system has a first sensor, a controller, and an alarm signal generator. The controller is capable of detecting that the first sensor, with the security system in an armed state, has changed from the secured state, and as an incident thereof, causing a signal to be generated by the alarm signal generator. The controller and first sensor are configured so that under certain conditions the first sensor must be changed from the unsecured state into the secured state and maintained in the secured state for a predetermined time period before the controller, first sensor and alarm signal generator can thereafter interact to produce a detectable signal in the event of a security breach.

19 Claims, 2 Drawing Sheets

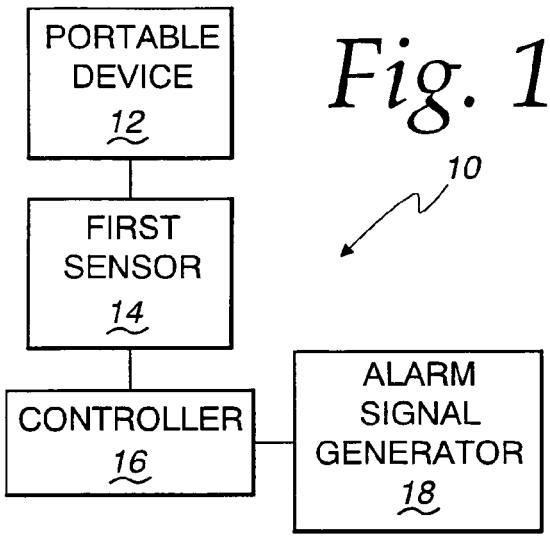
Fig. 1
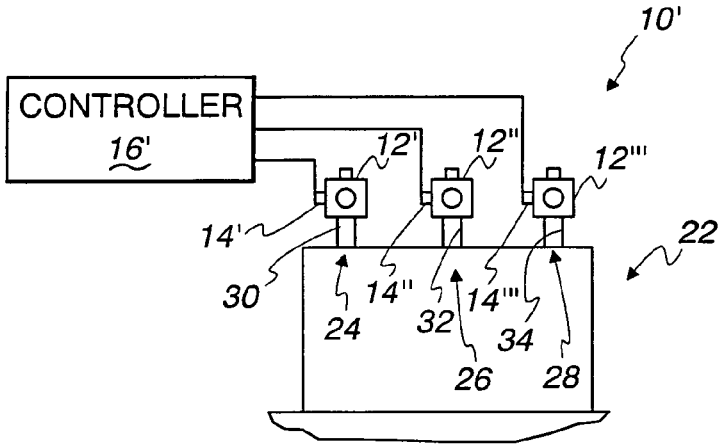
Fig. 2
Fig. 3
(Prior Art)
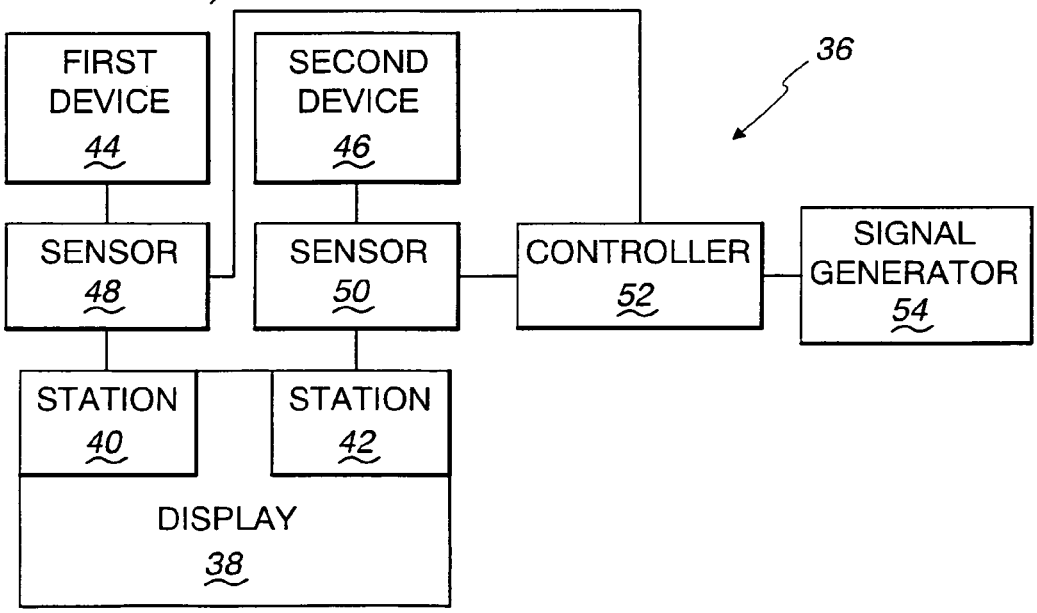

SECURITY SYSTEM FOR PORTABLE DEVICE WITH ARMING FEATURE

BACKGROUND OF THE INVENTION

1. Field of the Invention

This invention relates to security systems as used to monitor portable devices and, more particularly, to such a system with an electronic sensor that is attached to each such device.

2. Background Art

Electronic security systems are used in many retail establishments to monitor portable devices that are prone to being discretely removed from the premises at which they are displayed. Electronic devices, which continue to become more compact in size and expensive in nature, are particularly vulnerable in retail establishments whereat they are displayed in large numbers for hands-on inspection and operation by potential purchasers.

The multitude of competing manufacturers and different designs offered by each has caused displays often to be crowded with a particular type of product. For example, a single display may accommodate dozens of digital cameras made by different distributors and offered with many different features and in many different price ranges. The cost of these cameras generally warrants the investment in sophisticated electronic security systems.

In a typical retail establishment, a display of the above type will be designed with a discrete number of stations, each capable of accommodating a single device at which informational materials can be displayed to be visible in close proximity in association with the device. The security system, while normally adaptable to change the number of devices that it will accommodate, is typically set up so that the number of sensors corresponds to the number of stations. Preparatory to placing the security system in an armed state, the sensors are attached, one each, to a device at a station and are changed from an unsecured state into a secured state. This is commonly accomplished by adhering the sensor directly to the device in a manner whereby a captive actuating plunger is repositioned to change the state of the sensor.

The controller on the security system may be designed so that the system can be armed only once the active sensors are in their secured states. This feature avoids situations whereby the overall system may be armed but individual sensors remained in an unsecured state, due to improper sensor attachment or malfunction, whereby the associated devices are vulnerable to theft.

Other systems do not incorporate this feature and have controls that allow the arming of the system while certain sensors remain in place but unattached to a device at a particular station. This capability may be desirable from the standpoint that it gives greater system flexibility. That is, no special measures need be taken in the event that there are one or more stations at which there is no device displayed. At the time that the system is placed in the armed state, the controller will detect the unsecured state of one or more of the sensors and nonetheless permit arming of the system.

This latter design is particularly desirable from the standpoint of convenience and system integrity. In the absence of this feature, the system operator would be forced to make a manual adjustment, as by putting a shunt in a port accommodating the inactive sensor(s), or otherwise programming or adapting the system. This is inconvenient since often the controller for the system is placed within a closed cabinet so that it is not easily accessible, with the objectives thereby of contributing to aesthetics and avoiding controller tampering.

With this type of system, the sensor that is in the inactive state may cause a detectable alarm signal to be generated in response to the changing of the position of the plunger on the sensor with the system in the unarmed state. If for any reason, intentional or unintentional, the plunger on the inactive sensor(s) is repositioned, an alarm will be triggered. This condition may cause embarrassment to a potential customer and is an inconvenience to personnel at the particular establishment. This may cause an operator to disable the entire system, exposing the displayed devices to theft.

The main objective of designers of the above types of systems is to devise systems that are reliable in performance. Secondly, they must be "user friendly". If the system is inconvenient to operate or has "quirks" that translate into user inconvenience, employees may be inclined to avoid arming of the system, whereby the entire collection of displayed devices is prone to being removed by a thief. In line with this latter objective, the system should be versatile enough to allow the convenient selective placement and re-placement of devices at, and removal of the same from, individual stations. If a system compromises the ability to effectively display products for potential consumers, those involved in using such systems may be tempted to bypass them, thereby negating the value of the investment in the system and exposing the associated devices to theft.

The industry continues to seek designs of security systems that effectively meet the above objectives.

SUMMARY OF THE INVENTION

In one form, the invention is directed to a security system for a portable device. The security system has a first sensor that is capable of being operatively attached to a portable device. The first sensor has a secured state and an unsecured state. The security system further has a controller that is capable of sensing the state of the first sensor and an alarm signal generator. The security system has an armed state and an unarmed state. The controller is capable of detecting that the first sensor, with the security system in the armed state, has changed from the secured state into the unsecured state and, as an incident thereof, causing the alarm signal generator to cause a detectable signal to be generated. The controller and first sensor are configured so that with the security system in the unarmed state and the first sensor changed from the secured state into the unsecured state: a) the security system can be changed from the unarmed state into the armed state after which the first sensor can be changed from the unsecured state into the secured state, whereupon the controller will detect changing of the first sensor from the secured state into the unsecured state and cause the alarm signal generator to cause a detectable signal to be generated; and b) the first sensor must be changed from the unsecured state into the secured state and maintained in the secured state for a predetermined time period before the controller, first sensor and alarm signal generator can thereafter interact to cause the alarm signal generator to cause a detectable signal to be generated in the event that the first sensor is changed from the secured state into the unsecured state, with the security system in the armed state.

The predetermined time period may be at least 15 seconds.

In one form, the predetermined time period is at least one minute.

The predetermined time period may be on the order of two minutes.

In one form, the controller and first sensor are configured so that the first sensor must be changed from the unsecured state into the secured state after the security system is changed from the unarmed state into the armed state to allow the controller and sensor to interact to cause the alarm signal generator to cause a detectable signal to be generated in the event that the first sensor is changed from the secured state into the unsecured state.

In one form, the controller and first sensor are configured so that in the event the first sensor is changed from the secured state into the unsecured state with the security system in the unarmed state and the first sensor is maintained in the unsecured state, changing of the security system from the unarmed state into the armed state will not cause the controller to cause the alarm signal generator to cause a detectable signal to be generated.

In one form, there is at least one conductive wire that electrically connects between the first sensor and the controller.

The first sensor may have a housing and an element on the housing that moves between first and second positions relative to the housing to thereby change the first sensor between the secured and unsecured states.

In one form, there is at least one sensor in addition to the first sensor that interacts with the controller in the same manner that the first sensor interacts with the controller.

In one form, the element on the housing is biased by a force towards one of the first and second positions and is captive, between a portable device to which the first sensor is operatively attached and a part of the sensor, to thereby be urged against the biasing force into the other of the first and second positions.

The first sensor and controller may communicate with each other without a hard-wired connection therebetween.

The security system may be provided in combination with a portable device to which the first sensor is operatively attached.

The portable device may be in the form of an electronic device.

The invention is further directed to a method of monitoring a portable device. The method involves providing a security system having armed and unarmed states. The security system has a first sensor with secured and unsecured states, a controller that is capable of sensing the state of the first sensor, and an alarm signal generator. The method further includes the steps of operatively attaching the first sensor to the portable article and changing the first sensor from the unsecured state into the secured state to allow the controller, with the security system in the armed state, to interact with the first sensor to cause the alarm signal generator to cause a detectable signal to be generated in the event that the first sensor is thereafter changed back into the unsecured state, only after the first sensor is maintained in the secured state for a predetermined time period.

In one form, the step of the changing the first sensor from the unsecured state into the secured state involves changing the first sensor from the unsecured state into the secured state only after the first sensor was: a) initially in the secured state with the security system armed so that it the event the first sensor is thereafter changed from the secured state into the unsecured state, the controller causes the alarm signal generator to cause a detectable signal to be generated; and b) thereafter changed from the secured state into the unsecured state with the security system in the unarmed state.

In one form, the step of changing the first sensor from the unsecured state into the secured state involves changing the first sensor from the unsecured state into the secured state only after the first sensor is maintained in the secured state for a predetermined time period of at least 15 seconds.

This predetermined time period may be at least one minute or, in another form, on the order of two minutes.

In one form, the step of providing a security system involves providing a security system with a first sensor having a housing and an element on the housing that moves between first and second positions relative to the housing to thereby change the first sensor between the secured and unsecured states.

The step of operatively attaching the first sensor to the portable device may involve operatively attaching the first sensor to a portable electronic device at a point-of-purchase display.

BRIEF DESCRIPTION OF THE DRAWINGS

FIG. 1 is a schematic representation of a security system for a portable device, according to the present invention, and including an interactive first sensor, controller, and alarm signal generator;

FIG. 2 is a partially schematic representation of a point-of-purchase display at which electronic devices are on display and operatively interconnected with the security system of FIG. 1;

FIG. 3 is a schematic representation of a conventional display with multiple devices thereon and a known form of security system for monitoring the devices;

DETAILED DESCRIPTION OF THE DRAWINGS

Figure 4:
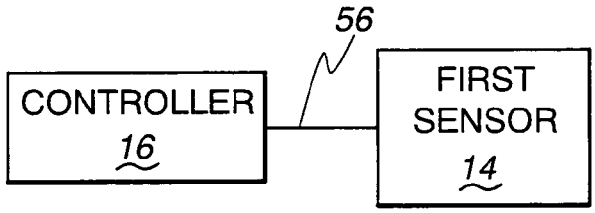
FIG. 4 is a partially schematic representation of a hard-wired connection between the controller and first sensor of FIG. 1.

In FIG. 1, a security system, according to the present invention, is shown at 10 for a portable device 12. The security system 10 is shown in schematic form in that the inventive concept is not limited to a specific design for any of the components thereof. The invention contemplates encompassing all variations of these components consistent with the inventive concepts disclosed and claimed herein.

The security system 10 consists of a first sensor 14 that is capable of being operatively attached to the portable device 12. The first sensor 14 has a secured state and an unsecured state.

A controller 16 is capable of sensing the state of the first sensor 14.

The security system 10 further includes an alarm signal generator 18. The alarm signal generator 18, in response to a signal/command from the controller 16, causes a detectable signal to be generated, thereby alerting an operator of the security system 10 to a condition that requires attention.

The nature of the signal is not critical to the present invention. For example, the alarm signal generator 18 may cause a signal to be generated that is audibly or visually detectable by someone in the vicinity of the portable device 12, or remotely located therefrom. The signal might alternatively be a transmission that can be received by a portable telephone or a computer. The communication between the controller 16 and alarm signal generator 18 may be effected through a wireless or hard-wired connection.

The security system 10 has an armed stated and an unarmed state. In the unarmed state, the alarm signal generator 18 will either not cause any signal to be generated or alternatively may cause a signal to be generated that is different than one that would be generated in the event that there is a security breach with the system 10 in the armed state.

The controller 16 is capable of detecting that the first sensor 14 has changed from the secured state into the unsecured state. As an incident thereof, with the security system 10 in the armed state, the controller 16 causes the alarm signal generator 18 to cause the aforementioned detectable signal to be generated with the security system 10.

The controller 16 and first sensor 14 are configured so that with the security system 10 in the unarmed state and the first sensor 14 changed from the secured state into the unsecured state: a) the security system can be changed from the unarmed state into the armed state after which the first sensor 14 can be changed from the unsecured state into the secured state, whereupon the controller 16 will detect change of the first sensor 14 from the secured state into the unsecured state and cause the alarm signal generator 18 to cause a detectable signal to be generated; and b) the first sensor 14 must be changed from the unsecured state into the secured state for a predetermined time period before the controller 16, first sensor 14, and alarm signal generator 18 can thereafter interact to cause the alarm signal generator 18 to cause a detectable signal to be generated in the event that the first sensor 14 is changed from the secured state into the unsecured state.

It is contemplated that the invention be used in virtually any environment in which portable devices are vulnerable to being taken without detection, exemplary of which is the point-of-purchase display shown at 22 in FIG. 2. Additionally, it is further contemplated that the security system 10 be utilized to monitor more than one, and potentially a large number of, portable devices 12 on display where they are accessible to potential customers.

With the security system 10' shown in FIG. 2, an exemplary portable device 12 is an electronic device, such as the various cameras 12', 12", 12'" depicted on the point-of-purchase display 22. While the nature of the portable device 12, shown schematically in FIG. 1, is not critical to the present invention, the invention lends itself to use particularly with small electronic devices as commonly put out in large numbers at point-of-purchase displays in retail establishments.

As noted above, typically a point-of-purchase display will have a number of stations, with three such stations shown in FIG. 2 at 24, 26, 28, each designed to accommodate one of the portable devices 12', 12",12'", successively. In this particular display 22, the stations 24, 26, 28 each has its own associated product support stand 30, 32, 34 and a sensor 14', 14", 14'", each operatively associated with a controller 16'.

In the event that there are more stations 24, 26, 28 available then there are devices 12', 12", 12'" to display, one or more of the stations 24, 26, 28 may not at all times have a device thereon being operatively monitored by the security system 10'.

Systems have been designed in the past so that once set up and armed with "X" number of devices, changing of the display to operatively interact less than the X number of devices with the security system creates problems for the system operator. Certain of these problems will be described with respect to the prior art arrangement shown at 36 in FIG. 3. In that Figure, a display 38 is shown with stations 40, 42 to accommodate separate first and second devices 44, 46. Sensors 48, 50 are operatively attached, one each to the first and second devices 44, 46, respectively. Through a controller 52, the state of the sensors 48, 50 can be monitored. With both sensors 48, 50 in a secured state and the system in an armed state, changing of either sensor 48, 50 from its secured state into its unsecured state is detected by the controller 52, which causes a signal generator 54 to generate a detectable signal alerting an individual or individuals monitoring the system to this condition.

The controller 52 and sensors 48, 50 have commonly been heretofore designed so that in the event the system is set up as in FIG. 3 and thereafter reconfigured by placing the same in an unarmed state and changing one of the sensors 48, 50 into the unsecured state, as by removing one of the devices 44, 46 to create an inactive sensor, complications arise. An unwanted signal may be generated in the event that the inactive sensor 48, 50 remains in circuit but is changed into the secured state. This may be effected by a potential consumer inadvertently manipulating a button that changes position to change the state of the sensor 48, 50. Alternatively, such systems may be configured so that a detectable alarm signal will be generated immediately upon the system's being changed into the armed state with one of the sensors 48, 50 in circuit but in the unsecured state therefor.

Avoidance of these conditions has heretofore required either that the inactive sensor 48, 50 be placed in the secured state without a product associated therewith, or the controller 50 be reprogrammed to take the inactive sensor 48, 50 out of circuit. Either of these activities requires operator intervention that is inconvenient and may be sufficiently burdensome that the operator may opt to leave the entire system unarmed to avoid false alarm signals.

According to the invention, the controller 16 and first sensor 14 are configured so that no alarm signal is caused to be generated by the inactive first sensor 14 until after it is changed from the unsecured state into the secured state and maintained in that condition for a predetermined time period. To provide the greatest flexibility, the system is designed in one form so that this may be done with the system 10 either in the armed or unarmed states. The ability to incorporate the inactive sensor, with the system armed, allows adding of devices to a display without burdensome inconvenience. That is, once the system 10 is armed, the user can modify the security system 10 to add a device without shutting the system down or effecting any reprogramming.

In one preferred form, the controller 16 is designed to arm sensors that were previously in circuit and changed from an unsecured state into a secured state and back into the unsecured state as through the separation of a device therefrom. However, it is not a requirement that the system be operational only after the sensor state is changed back and forth, as indicated above.

The predetermined time period/delay, that is described above, may vary considerably in duration. It is preferably at least 15 seconds and may be greater than one minute. In one preferred form, the time period is on the order of 2 minutes. Any of these time durations is likely to avoid any inadvertent generation of a false signal, as by an individual's intentionally or unintentionally changing the state of an inactive sensor.

As noted above, the controller 16 and first sensor 14 may be configured so that the first sensor 14 must be changed from the unsecured state into the secured state after the security system 10 is changed from the unarmed state into the armed state to allow the controller 16 and sensor 14 to interact to cause the alarm signal generator to cause a detectable signal to be generated in the event that the first sensor 14 is changed from the secured state into the unsecured state.

In any event, it is desirable that the controller 16 and first sensor 14 are configured so that in the event the first sensor 14 is changed from the secured state into the unsecured state with the security system in the unarmed state and the first sensor is maintained in the unsecured state, changing of the security system 10 from the unarmed state into the armed state will not cause the controller 16 to cause the alarm signal generator 18 to cause a detectable signal to be generated.

The schematic depiction of the interaction of the first sensor 14 and controller 16 is intended to encompass wired and wireless communication between these components. As shown in FIG. 4, a wired connection may include at least one conductive wire 56 that connects between the first sensor 14 and controller 16.

Figure 5:
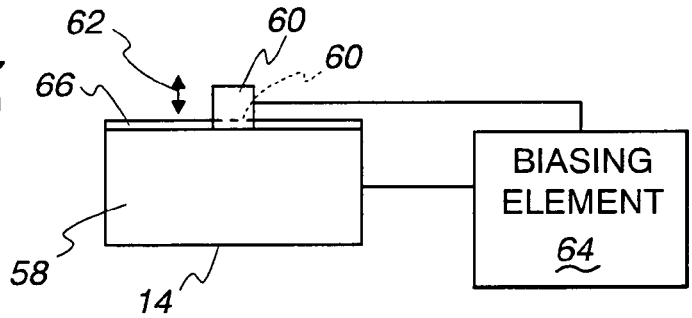
FIG. 5 is a partially schematic representation of one form of sensor, as shown in FIG. 1.

The first sensor 14 may have virtually an unlimited number of different forms, well known to those skilled in the art. As just one example, as shown in FIG. 5, the sensor 14 may have a housing 58 with an element 60 that is moveable relative to the housing 58 along the line of the double-headed arrow 16 between a first, solid line position and a second, dotted line position in that same Figure. With the element 60 in the first, solid line position, the sensor 14 is in the unsecured state therefor. In the second, dotted line position for the element 60, the sensor 14 is in the secured state.

In one form, there is a biasing element 64 that exerts a force that normally urges the element 60 to the first, solid line position. With the sensor 14 operatively attached to the portable device 12, the element 60 is placed in a captive relationship. Relative movement of the housing 58 towards the device 12 causes the element 60 to move under a captive force from the first, solid line position, into the second, dotted line position against a force developed by the biasing element 64.

The sensor 14 may be operatively attached to the device 12 by any type of fastener. One exemplary form is a double-sided adhesive layer 66, as shown in FIG. 5.

Figure 6:
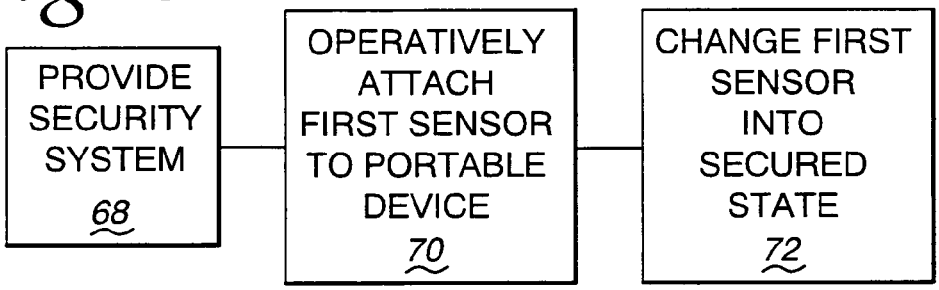
FIG. 6 is a flow diagram representation of a method of monitoring a portable device according to the invention.

The invention contemplates a method of monitoring a portable device using a system of the same general type described above. The method is describe in flow diagram form initially in FIG. 6. More specifically, as shown at block 68, a security system is provided having an armed state and unarmed state and made up of at least: a) a first sensor with secured and unsecured states; b) a controller that is capable of sensing the state of the first sensor; and c) an alarm signal generator.

As shown at block 70, the first sensor is operatively attached to a portable device.

As shown at block 72, the first sensor is changed from the unsecured state into the secured state to allow the controller, with the security system in the armed state, to interact with the first sensor to cause the alarm signal generator to cause a detectable signal to be generated in the event that the first sensor is thereafter changed back into the unsecured state, only after the first sensor is maintained in the secured state for a predetermined time period.

Figure 7:
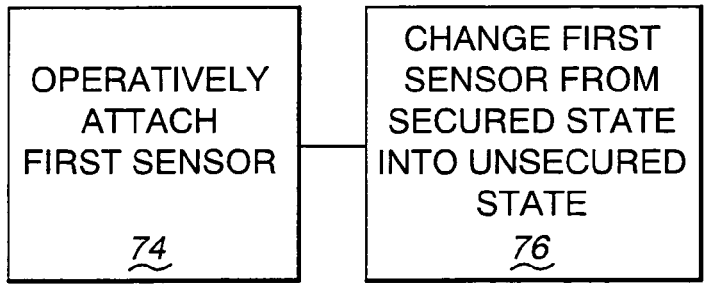
FIG. 7 is a flow diagram representation of one specific variation of the method shown in FIG. 6.

In one form, as depicted in flow diagram form in FIG. 7, the step of changing the first sensor from the unsecured state into the secured state involves changing the first sensor from the unsecured state into the secured state only after: a) the first sensor is initially operatively attached to the portable device, as shown at block 74 with the security system armed and the first sensor in the secured state, so that in the event the first sensor is thereafter changed from the secured state into the unsecured state, the controller causes the alarm signal generator to cause a detectable signal to be generated; and b) as shown at block 76 the first sensor is thereafter changed from the secured state into the unsecured state with the security system in the unarmed state.

The foregoing disclosure of specific embodiments is intended to be illustrative of the broad concepts comprehended by the invention.

The invention claimed is:

1. A security system for a portable device, the security system comprising:

a plurality of sensors each capable of being operatively attached to a portable device, the sensors each having a secured state and an unsecured state;

a controller that is capable of sensing the state of the sensors; and an alarm signal generator, the security system having an armed state and an unarmed state, the controller capable of detecting that each of the sensors, with the security system in the armed state, has changed from the secured state into the unsecured state and, as an incident thereof, causing the alarm signal generator to cause a detectable signal to be generated, the controller and sensors configured so that with the security system in the unarmed state with one of the sensors in the plurality of sensors in the secured state and a first sensor in the plurality of sensors separate from the one sensor in the unsecured state: a) the security system can be changed from the unarmed state into the armed state with the one sensor in the secured state after which the first sensor can be changed from the unsecured state into the secured state whereupon the controller will detect changing of the first sensor from the secured state into the unsecured state and cause the alarm signal generator to cause a detectable signal to be generated; and b) the first sensor must be changed from the unsecured state into the secured state and maintained in the secured state for a predetermined time period before the controller, first sensor and alarm signal generator can thereafter interact to cause the alarm signal generator to cause a detectable signal to be generated in the event that the first sensor is changed from the secured state into the unsecured state with the security system in the armed state.

2. The security system for a portable device according to claim 1 wherein the predetermined time period is at least 15 seconds.

3. The security system for a portable device according to claim 1 wherein the predetermined time period is at least 1 minute.

4. The security system for a portable device according to claim 1 wherein the predetermined time period is on the order of 2 minutes.

5. A security system for a portable device, the security system comprising:

a first sensor that is capable of being operatively attached to a portable device, the first sensor having a secured state and an unsecured state;

a controller that is capable of sensing the state of the first sensor; and an alarm signal generator, the security system having an armed state and an unarmed state, the controller capable of detecting that the first sensor, with the security system in the armed state, has changed from the secured state into the unsecured state and, as an incident thereof, causing the alarm signal generator to cause a detectable signed to be generated, the controller and first sensor configured so that with the security system in the unarmed state and the first sensor changed from the secured state into the unsecured state: a) the security system can be changed from the unarmed state into the armed state after which the first sensor can be changed from the unsecured state into the secured state whereupon the controller will detect changing of the first sensor from the secured state into the unsecured state and cause the alarm signal generator to cause a detectable signal to be generated; and b) the first sensor must be changed from the unsecured state into the secured state and maintained in the secured state for a predetermined time period before the controller, first sensor and alarm signal generator can thereafter interact to cause the alarm signal generator to cause a detectable signal to be generated in the event that the first sensor is changed from the secured state into the unsecured state with the security system in the armed state, wherein the controller and first sensor are configured so that the first sensor must be changed from the unsecured state into the secured state after the security system is changed from the unarmed state into the armed state to allow the controller and sensor to interact to cause the alarm signal generator to cause a detectable signal to be generated in the event that the first sensor is changed from the secured state into the unsecured state.

6. A security system for a portable device, the security system comprising:

a first sensor that is capable of being operatively attached to a portable device, the first sensor having a secured state and an unsecured state;

a controller that is capable of sensing the state of the first sensor; and an alarm signal generator, the security system having an armed state and an unarmed state, the controller capable of detecting that the first sensor, with the security system in the armed state, has changed from the secured state into the unsecured state and, as an incident thereof causing the alarm signal generator to cause a detectable signed to be generated, the controller and first sensor configured so that with the security system in the unarmed state and the first sensor changed from the secured state into the unsecured state: a) the security system can be changed from the unarmed state into the armed state after which the first sensor can be changed from the unsecured state into the secured state whereupon the controller will detect changing of the first sensor from the secured state into the unsecured state and cause the alarm signal generator to cause a detectable signal to be generated; and b) the first sensor must be changed from the unsecured state into the secured state and maintained in the secured state for a predetermined time period before the controller, first sensor and alarm signal generator can thereafter interact to cause the alarm signal generator to cause a detectable signal to be generated in the event that the first sensor is changed from the secured state into the unsecured state with the security system in the armed state, wherein the controller and first sensor are configured so that in the event the first sensor is changed from the secured state into the unsecured state with the security system in the unarmed state and the first sensor is maintained in the unsecured state, changing of the security system from the unarmed state into the armed state will not cause the controller to cause the alarm signal generator to cause a detectable signal to be generated.

7. The security system for a portable device according to claim 1 wherein there is at least one conductive wire that electrically connects between the first sensor and the controller.

8. The security system for a portable device according to claim 1 wherein the first sensor comprises a housing and an element on the housing that moves between first and second positions relative to the housing to thereby change the first sensor between the secured and unsecured states.

9. The security system for a portable device according to claim 8 wherein the element on the housing is biased by a force towards one of the first and second positions and is captive between a portable device to which the first sensor is operatively attached and a part of the sensor to thereby be urged against the biasing force into the other of the first and second positions.

10. The security system for a portable device according to claim 8 wherein the first sensor and controller communicate with each other without a hard-wired connection between the first sensor and controller.

11. The security system for a portable device according to claim 1 in combination with a portable device to which the first sensor is operatively attached.

12. The security system for a portable device according to claim 11 wherein the portable device is an electronic device.

13. A method of monitoring portable devices, the method comprising the steps of:

providing a security system having armed and unarmed states and comprising:

a) first and second sensors each with secured and unsecured states;

b) a controller that is capable of sensing the state of the first and second sensors; and c) an alarm signal generator;

operatively attaching the first sensor to a portable device with the second sensor operatively attached to another portable article and with the security system in the armed state; and changing the first sensor from the unsecured state into the secured state with the second sensor operatively attached to the another portable article to allow the controller, with the security system maintained in the armed state, to interact with the first sensor to cause the alarm signal generator to cause a detectable signal to be generated in the event that the first sensor is thereafter changed back into the unsecured state, only after the first sensor is maintained in the secured state for a predetermined time period.

14. The method of monitoring a portable device according to claim 13 wherein the step of changing the first sensor from the unsecured state into the secured states comprises changing the first sensor from the unsecured state into the secured state only after the first sensor was: a) initially in the secured state with the security system armed so that in the event the first sensor is thereafter changed from the secured state into the unsecured state, the controller causes the alarm signal generator to cause a detectable signal to be generated; and b) thereafter changed from the secured state into the unsecured state with the security system in the unarmed state.

15. The method of monitoring a portable device according to claim 13 wherein the step of changing the first sensor from the unsecured state into the secured state comprises changing the first sensor from the unsecured state into the secured state only after the first sensor is maintained in the secured state for a predetermined time period of at least 15 seconds.

16. The method of monitoring a portable device according to claim 13 wherein the step of changing the first sensor from the unsecured state into the secured state comprises changing the first sensor from the unsecured state into the secured state only after the first sensor is maintained in the secured state for a predetermined time period of at least 1 minute.

17. The method of monitoring a portable article according to claim 13, wherein the step of changing the first sensor from the unsecured state into the secured state comprises changing the first sensor from the unsecured state into the secured state only after the first sensor is maintained in the secured state for a predetermined time period of on the order of 2 minutes.

18. The method of monitoring a portable device according to claim 13 wherein the step of providing a security system comprises providing a security system with a first sensor comprising a housing and an element on the housing that moves between first and second positions relative to the housing to thereby change the first sensor between the secured and unsecured states.

19. The method of monitoring a portable device according to claim 13 wherein the step of operatively attaching the first sensor to the portable device comprises operatively attaching the first sensor to a portable electronic device at a point-of-purchase display.

* * * * *